US007201610B2

(12) United States Patent
Chao et al.

(10) Patent No.: US 7,201,610 B2
(45) Date of Patent: Apr. 10, 2007

(54) NETWORK DEVICE WITH POWER OUTPUTTING SOCKET

(75) Inventors: Li-Chun Chao, Hsinchu (TW); Hsin-Nan Kuo, Jhubei (TW); Yu-Ting Lin, Jhubei (TW)

(73) Assignee: Accton Technology Corporation, Hsinchu (TW)

( * ) Notice: Subject to any disclaimer, the term of this patent is extended or adjusted under 35 U.S.C. 154(b) by 155 days.

(21) Appl. No.: 11/020,199

(22) Filed: Dec. 27, 2004

(65) Prior Publication Data

US 2005/0208836 A1 Sep. 22, 2005

(30) Foreign Application Priority Data

Mar. 18, 2004 (TW) ..... 93107357 A

(51) Int. Cl.

| | |
|---|---|
| ***H01R 25/00*** | (2006.01) |
| ***H01R 27/02*** | (2006.01) |
| ***H01R 31/00*** | (2006.01) |
| ***H01R 33/92*** | (2006.01) |
| ***H01R 33/94*** | (2006.01) |

(52) U.S. Cl. ..... 439/638; 439/639

(58) Field of Classification Search ..... 439/638, 439/639, 320, 322, 323; 375/222, 220, 219; 709/223; 710/300

See application file for complete search history.

(56) References Cited

U.S. PATENT DOCUMENTS

| | | | | |
|---|---|---|---|---|
| 5,913,690 | A * | 6/1999 | Dechelette et al. | 439/108 |
| 7,043,543 | B2 * | 5/2006 | Ewing et al. | 709/223 |
| 2002/0025710 | A1 * | 2/2002 | Payson et al. | 439/320 |
| 2002/0042857 | A1 * | 4/2002 | Jones et al. | 710/300 |
| 2003/0035471 | A1 * | 2/2003 | Pitsoulakis | 375/222 |

* cited by examiner

*Primary Examiner*—Chandrika Prasad
(74) *Attorney, Agent, or Firm*—Rabin & Berdo, PC

(57) ABSTRACT

A network device including a power receiving socket, a power supply, a network controller, plural connection ports and a power outputting socket is provided. The power receiving socket is for receiving an external power and outputting a supply power. The power supply is electrically connected with the power receiving socket for receiving the supply power, wherein the power supply has the received supply power rectified and voltage-reduced, then outputs a direct current power. The network controller operates according to direct current power. The plural connection ports respectively are respectively electrically connected with the network controller. The power outputting sockets is electrically connected with the power receiving socket for receiving and outputting the supply power.

22 Claims, 3 Drawing Sheets

NETWORK DEVICE WITH POWER OUTPUTTING SOCKET

This application claims the benefit of Taiwan application Ser. No. 93107357, filed Mar. 18, 2004, the subject matter of which is incorporated herein by reference.

BACKGROUND OF THE INVENTION

1. Field of the Invention

The invention relates in general to a network device, and more particularly to a network device with a power socket.

2. Description of the Related Art

In recent years, network devices such as network switch or network router are getting more and more popular. The advantage and benefits of using the network devices to connect network equipment outdo the inter-connection among elements of network equipment.

Take a network switch for example. The network switch enables mutual transmission of information between plural nodes connected to the network switch, for example, plural hosts. When receiving a packet, first of all, the network switch looks the target node of the packet up in its own address table. If the target node can be found, the packet is outputted to the target node via the corresponding connection port; if the target node cannot be found, the packet is broadcasted to all connection ports to assure that the target node can receive the packet.

In the configuration of a local area network, every host system is connected to a network device such as a network switch via a network connection cable by means of a network connection device such as a network card. Every host system is further connected to a power socket via a power line for providing the host system with necessary supply power. If the power socket is afar from the host system or the number of power sockets is insufficient, an extra extension line with power sockets will be used.

When more and more host systems need to be connected to a network, such design will lead to a messy, untidy and disordered environment. The network connection cables, power lines and extension line with sockets are scattered around, which is not only unpleasant in appearance but also susceptible of accidents.

SUMMARY OF THE INVENTION

It is therefore an object of the invention to provide a network device integrating the power socket and the network device together.

The invention achieves the above-identified object by providing a network device including a casing, a division plate, plural connection ports, a power receiving socket, a power outputting socket, a power supplier and a network controller. The casing has an accommodation space, at least a first aperture, a second aperture and a third aperture. The division plate divides the accommodation space into a first unit portion and a second unit portion for providing shielding effect. Parts of the structure of the connection ports are disposed in the first unit portion and correspond to the first aperture. The power receiving socket for receiving an external power and outputting a supply power is disposed in the second unit portion and corresponds to the second aperture. The power outputting socket is disposed in the second unit portion, corresponds to the third aperture, and is electrically connected with the power receiving socket for receiving and outputting a supply power. The power supplier, disposed in the second unit portion and electrically connected with the power receiving socket, receives a supply power, has the received supply power rectified and voltage-reduced, then outputs a direct current power. The network controller is disposed in the first unit portion, operates according to the direct current power, and is electrically connected with every connection port.

According to another identified object of the invention, a network device including a power receiving socket, a power supplier, a network controller, plural connection ports and a power outputting socket is provided. The power receiving socket is for receiving an external power and outputting a supply power. The power supplier is electrically connected with the power receiving socket for receiving the supply power, wherein the power supplier has the received supply power rectified and voltage-reduced, then outputs a direct current power. The network controller operates according to direct current power. The plural connection ports are respectively electrically connected with the network controller. The power outputting socket is electrically connected with the power receiving socket for receiving and outputting a supply power.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
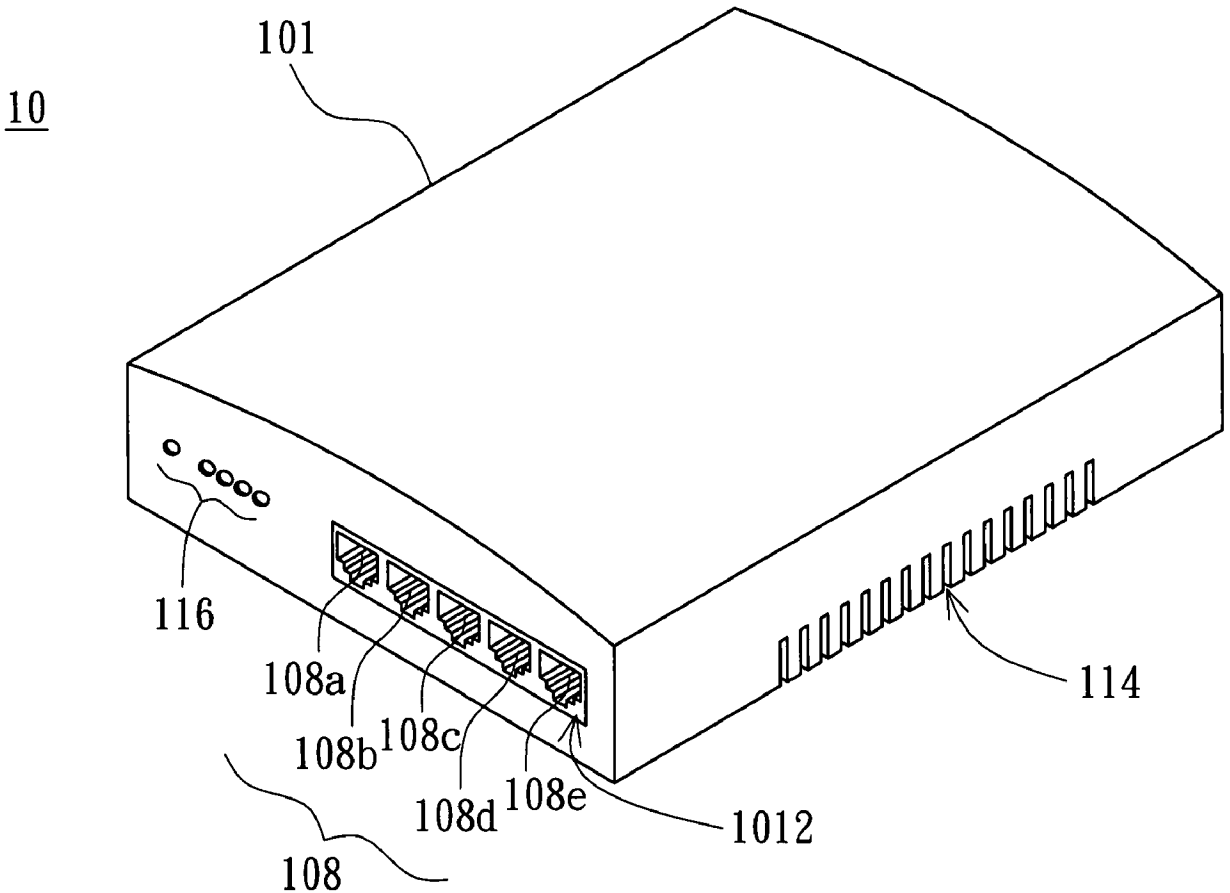
FIG. 1 is a 3D diagram of the network device according to a preferred embodiment of the invention.

Referring to FIG. 1, a 3D diagram of the network device according to a preferred embodiment of the invention is shown. The network device 10 includes a casing 101, connection ports 108*a*~108*e* and an indication light 116. The first aperture 1012 corresponds to the connection ports 108*a*~108*e* inside the casing 101, wherein casing 101 has a ventilation hole 114. The connection ports 108*a*~108*e* are disposed in the casing and corresponds to the first aperture 1012 for accommodating a network connection cable. The indication light 116 is for indicating the status of network connection.

Figure 2:
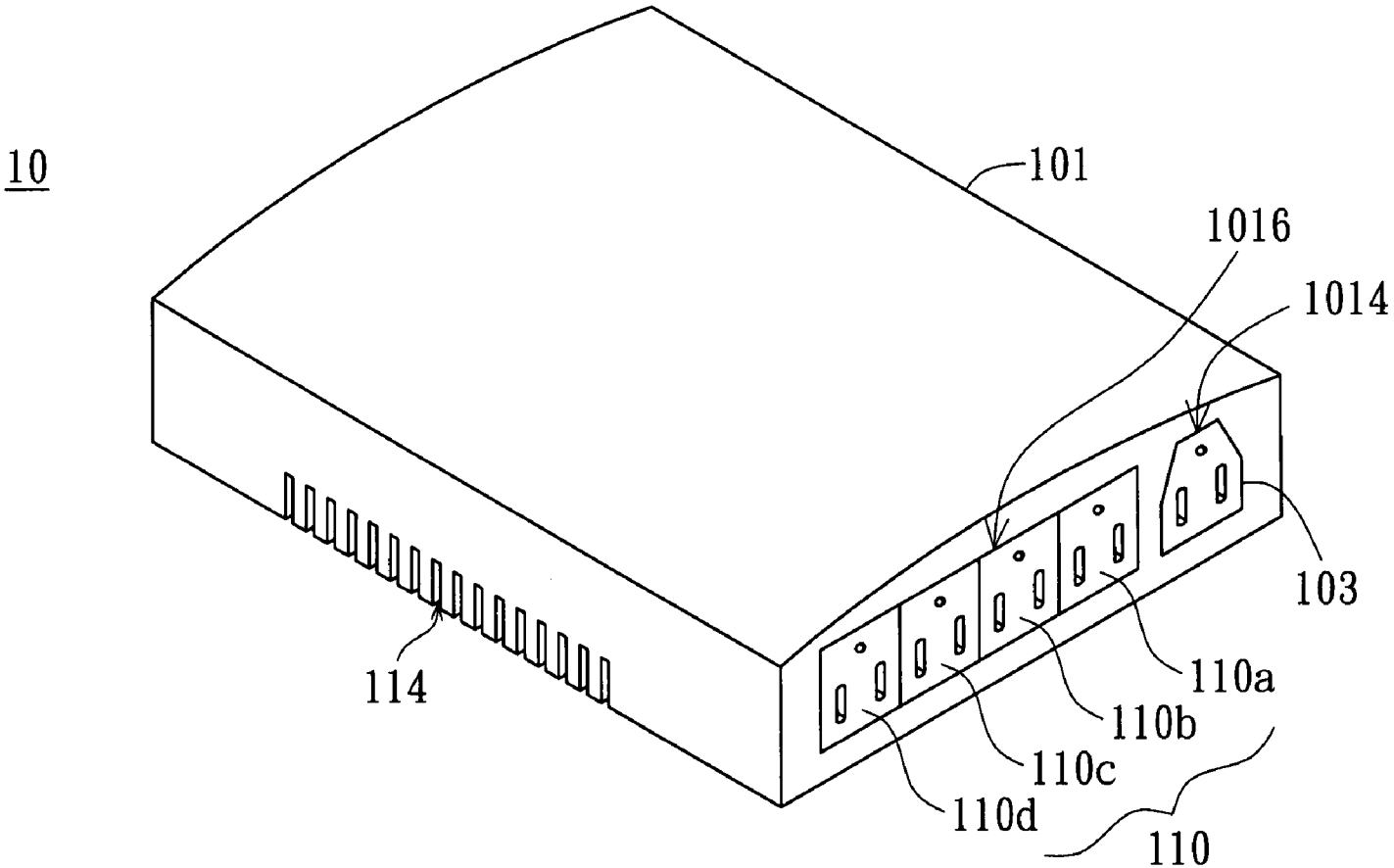
FIG. 2 is a 3D diagram of the network device according to a preferred embodiment of the invention viewed from another angle.

Referring to FIG. 2, a 3D diagram of the network device according to the preferred embodiment of the invention viewed from another angle is shown. The network device 10 further includes a power receiving socket 103 and power outputting sockets 110*a*, 110*b*, 110*c* and 110*d*, which are disposed in another side of casing 101. The power receiving socket 103 corresponds to the second aperture 1014 for receiving an external power and outputting a supply power; meanwhile, the supply power is an alternating current power of 110V~220V.

The power outputting socket 110, which corresponds to the third aperture 1016, is electrically connected with the power receiving socket 103 for receiving the supply power outputted by the power receiving socket 103 and transferring to external electronic devices, for example, plural computer hosts.

Figure 3:
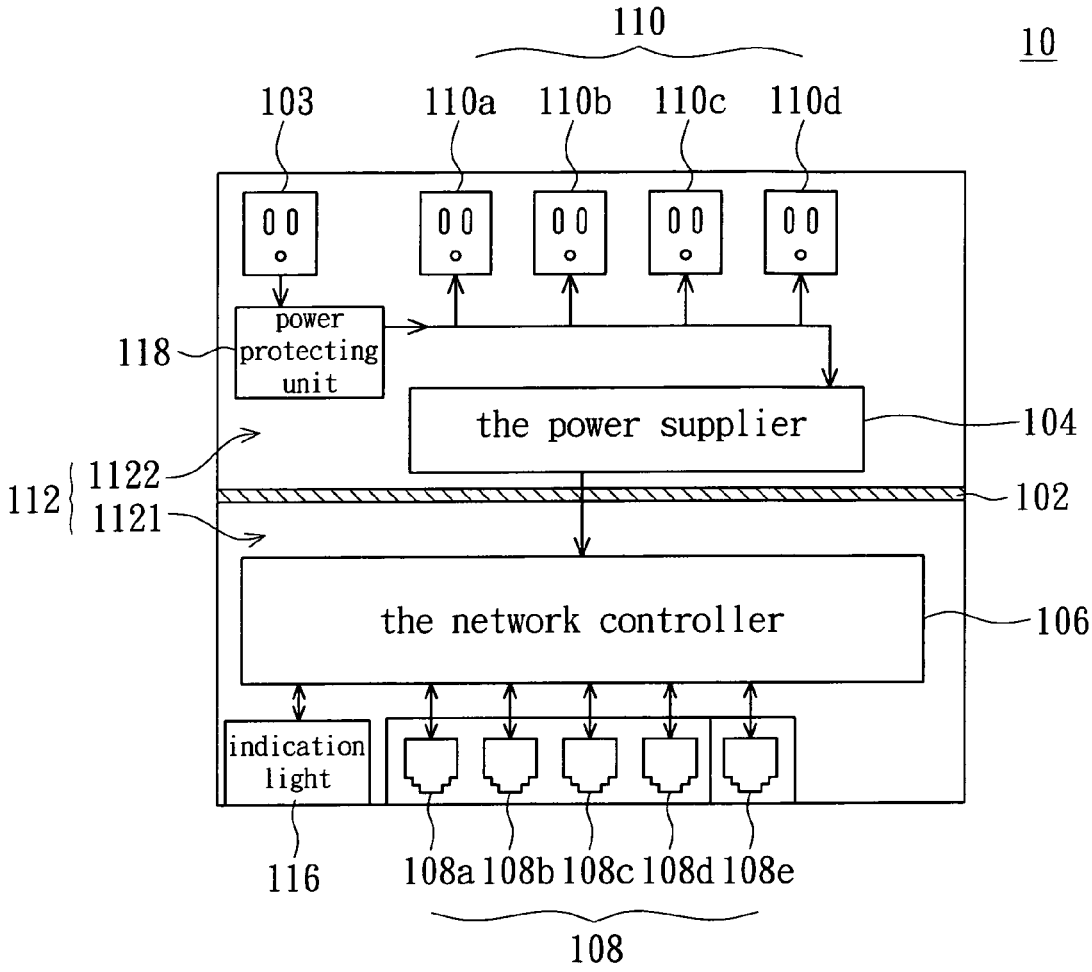
FIG. 3 is a block diagram of the network device according to a preferred embodiment of the invention.

Referring to FIG. 3, a block diagram of the network device is shown. The network device 10 includes a power protecting unit 118, a power supplier 104, a network controller 106 and a division plate 102 in addition to the power receiving socket 103, the power outputting socket 110, the connection port 108, and the indication light 116. The division plate 102 is for dividing the accommodation space 112 inside casing 101 into a first unit portion 1121 and a second unit portion 1122 for providing shielding effect. The first aperture 1012 (not shown in FIG. 3) is positioned on one side of the casing 101 and is adjacent to the first unit portion 1121 for the connection port 108 to be exposed outside the casing 101. The second aperture 1014 and the third aperture 1016 (not shown in FIG. 3) are positioned on another side of the casing 101 and are adjacent to the second unit portion 1122 for the power receiving socket 102 and the power outputting socket 110 to be exposed outside the casing 101. The division plate 102 can be made of metallic materials or have a conductive material coated on the surface of the division plate 102.

The power supplier 104 is disposed in the second unit portion 1122 and is electrically connected with the power receiving socket 103 for receiving the supply power outputted by the power receiving socket 103, wherein the power supplier 104 has the received alternating current supply power rectified and voltage-reduced, then outputs a direct current power; meanwhile, the direct current power is a direct current power of 5V~12V for example.

The network controller 106 is electrically connected with the power supplier 104 and operates according to the direct current power outputted by the power supplier 104. Besides, the connection port 108*a*~108*b* are respectively electrically connected with the network controller 106.

The network controller 106 can be a gigabit switch controller for example; meanwhile, the network device 10 is a gigabit switch. The operation of the switch controller is exemplified below. After receiving an external packet via any of the connection ports 108 in an Ethernet-based LAN environment, the switch controller, first of all, stores the packet in a buffer (not shown in the diagram), then looks up in the address table to determine the connection port corresponding to the target node of the packet.

The network controller 106 can be a router controller; meanwhile, the network device 10 serves as a network router. The network controller 106 can be a gateway controller; meanwhile, the network device 10 serves as a gateway. The network controller 106 also can be Fast Ethernet device, Access Point, or IP sharing device.

Besides, the network device 10 further has a power protecting unit 118. A power protecting unit 118 is used to protect the electronic elements inside the network device 10, for example, to prevent the occurrence of instant oversupply of power, wherein the power protecting unit 118 is a no-fuse breaker or a fuse.

It can be understood from the network device disclosed in the above preferred embodiment integrates the sockets into the network device to form a single body, so that plural power lines and network connection cables are all connected to the same network device, not only creating a tidy environment and reducing accidents, but also saving space and increasing portability. Moreover, one network device according to the preferred embodiment of the invention can produce the same effects and the same functions with plural extension lines with sockets and network devices and reduce users' burden. Therefore, the scope of application of the network device according to the preferred embodiment of the invention covers a wide range, such as offices, ordinary families and factories.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A network device comprising:

a casing having an accommodation space, at least a first aperture, a second aperture and a third aperture;

a division plate, which divides the accommodation space into a first unit portion and a second unit portion for providing a shielding effect;

a plurality of connection ports, wherein the connection ports correspond to the first aperture;

a power receiving socket for receiving an AC external power and outputting an AC supply power, wherein the power receiving socket corresponds to the second aperture;

a power outputting socket, which corresponds to the third aperture, and electrically connects with the power receiving socket for receiving and outputting the supply power;

a power supplier electrically connected with the power receiving socket, wherein the power supplier receives the supply power, has the received supply power rectified and voltage-reduced, and then outputs a direct current power; and a network controller receiving the direct current power and electrically connected with the connection ports.

2. The network device according to claim 1, wherein the division plate has a conductive material coated on the surface thereof.

3. The network device according to claim 1, wherein the network controller is a gigabit switch controller.

4. The network device according to claim 1, wherein the network controller is a router controller.

5. The network device according to claim 1, wherein the network controller is a gateway controller.

6. The network device according to claim 1, further comprising a power protecting unit, wherein the power receiving socket outputs the supply power via the power protecting unit.

7. The network device according to claim 6, wherein the power protecting unit is a no-fuse breaker.

8. The network device according to claim 6, wherein the power protecting unit is a fuse.

9. The network device according to claim 1, wherein. the connection ports and the network controller are disposed in the first unit portion.

10. The network device according to claim 1, wherein the power receiving socket, the power outputting socket, and the power supplier are disposed in the second unit portion.

11. The network device according to 1, wherein the division plate is made of metallic material.

12. A network device comprising:

a power receiving socket for receiving an AC external power and outputting an AC supply power;

a power supplier electrically connected with the power receiving socket for receiving the supply power, wherein the power supplier has the received supply power rectified and voltage-reduced, and then outputs a direct current power;

a network controller, which operates according to the direct current power;

a division plate positioned between the power supplier and the network controller for providing a shielding effect;

a plurality of connection ports respectively electrically connected with the network controller; and a power outputting socket electrically connected with the power receiving socket for receiving and outputting the supply power.

13. The network device according to claim 12, further comprising:

a casing, wherein the connection ports are disposed on one side of the casing, while the power outputting socket is disposed in another side of the casing opposite to the connection ports.

14. The network device according to claim 13, wherein the casing has an accommodation space that is divided into a first unit portion and a second unit by the division plate, the connection ports and the network controller being disposed in the first unit portion, and the power receiving socket, the power outputting socket and the power supplier being disposed in the second unit portion.

15. The network device according to claim 12, wherein the division plate is made of metallic material.

16. The network device according to claim 12, wherein the division plate has a conductive material coated on the surface thereof.

17. The network device according to claim 12, further comprising a power protecting unit, wherein the power receiving socket outputs the supply power via the power protecting unit.

18. The network device according to claim 17, wherein the power protecting unit is a no-fuse breaker.

19. The network device according to claim 17, wherein the power protecting unit is a fuse.

20. The network device according to claim 12, wherein the network device is a gigabit switch controller.

21. The network device according to claim 12, wherein the network controller is a router controller.

22. The network device according to claim 12, wherein the network controller is a gateway controller.

* * * * *